United States Patent [19]

Dey

[11] 4,106,469

[45] Aug. 15, 1978

[54] AUTOMATIC MOTOR KILL SYSTEM

[76] Inventor: James Dey, 1101 Woodlark, Tyler, Tex. 75701

[21] Appl. No.: 759,780

[22] Filed: Jan. 14, 1977

Related U.S. Application Data

[62] Division of Ser. No. 595,804, Jul. 14, 1975, Pat. No. 4,029,073.

[51] Int. Cl.[2] ..... F02B 77/00

[52] U.S. Cl. ..... 123/198 DB; 123/DIG. 11; 123/142; 123/97 B

[58] Field of Search .... 123/198 D, 198 DB, 198 DC, 123/198 R, DIG. 11, 142, 97 B, 139 AL

[56] References Cited

U.S. PATENT DOCUMENTS

| | | | |
|---|---|---|---|
| 2,084,426 | 6/1937 | Berry | 123/198 DB |
| 2,253,425 | 8/1941 | Garland | 123/198 D X |
| 3,528,787 | 9/1970 | Hallberg | 123/198 D X |
| 3,533,391 | 10/1970 | Lockmuller | 123/198 DB |
| 3,722,492 | 3/1973 | Shibata | 123/198 DB |
| 3,867,919 | 2/1975 | Grenier et al. | 123/198 D |

FOREIGN PATENT DOCUMENTS

| | | | |
|---|---|---|---|
| 1,166,556 | 3/1964 | Fed. Rep. of Germany | 123/198 B |

*Primary Examiner*—Charles J. Myhre
*Assistant Examiner*—Ira S. Lazarus
*Attorney, Agent, or Firm*—Richards, Harris & Medlock

[57] ABSTRACT

The specification discloses a motor kill system for automatically shutting off and killing an internal combustion engine to prevent damage to the engine from obstruction of the air cleaning system. The motor kill system includes a vacuum switch operating in response to a drop in the pressure between the air cleaning system and the intake manifold of the engine caused by obstruction of the air cleaning system. The preferred embodiment of the invention utilizes a normally open vacuum switch that closes to cause a solenoid to operate a butterfly valve to cut off the air supply to kill the engine. An alternate embodiment of the invention utilizes a normally closed vacuum switch which operates in response to obstruction of the air cleaning system to open the circuit between the ignition and the fuel pump to cut off the fuel supply and thereby kill the engine before any damage is done.

5 Claims, 4 Drawing Figures

AUTOMATIC MOTOR KILL SYSTEM

This application is a division of application Ser. No. 595,804, filed July 14, 1975, now U.S. Pat. No. 4,029,073.

FIELD OF THE INVENTION

This invention relates to automatic engine safety systems, and more particularly relates to a system for automatically cutting off the air or fuel supply to an engine when the system detects obstruction of the air cleaning system of the engine.

DESCRIPTION OF THE PRIOR ART

Many types of heavy construction equipment are operated under conditions where the surrounding air is filled with dust and other foreign matter that must be filtered from these engines. Highway construction projects and open pit mining operations are two examples of job sites where heavy air filters are used to protect large pieces of equipment, such as heavy duty trucks, bulldozers and scrapers. The loss of such equipment for engine repairs caused by failure of the air cleaning system may delay the job completion and add significantly to the construction costs.

Visual monitors or pressure gauges have been heretofore used on such equipment to show when an air cleaning system is becoming clogged from dirt and other foreign matter trapped in the air filters of the system. An internal combustion engine with a clogged air filter will labor to draw air to maintain combustion, at the same time producing a drop in pressure or vacuum between the manifold and air cleaning system which can pull such debris into the manifold. An operator who fails to continuously check the visual monitor will be unaware when such damage to the engine is occurring. Devices in the prior art require an operator to continually monitor such a pressure gauge and manually respond to a particular reading by operating a kill switch or button. It will be readily understood from the environment in which heavy equipment operators work that such a warning system will not always be noticed. Such failure to continuously monitor the pressure or operator indifference to the visual signal can result in time consuming and expensive repairs for the equipment.

It has been known to provide some type of automatic safety devices for internal combustion engines to prevent damage to the engine. Some prior engines safety system have utilized vacuum switches for sensing engine air pressures, such as the systems described in U.S. Pat. No. 2,131,264 issued to W. D. Benjamin on Sept. 27, 1938 and U.S. Pat. No. 2,712,813, issued to W. D. Thomas on July 12, 1955. However, such prior devices have not sensed when an air cleaning system becomes clogged in order to shut off the engine to prevent damage to the engine.

A need has thus arisen for an engine safety device which automatically detects obstruction of an air filter and shuts off the engine in response to this condition. Automatically shutting off the engine requires the operator to clean or change air filters before the equipment can be operated again. The change of damaging such a heavy piece of construction equipment is thereby substantially reduced by the use of an automatic engine safety device of the present invention.

SUMMARY OF THE INVENTION

The present invention provides a system for automatically shutting off an internal combustion engine when the air cleaning system for the engine becomes clogged or obstructed during operations.

In accordance with the present invention, an internal combustion engine having an air cleaning system connected by a pipe to the intake manifold of the engine includes a device for sensing a pressure decrease to a predetermined level in the air cleaning connection pipe resulting from an obstruction of the air cleaning system. Further, the automatic engine shut off system responds to the device detecting a pressure decrease to automatically shut off the engine before damage occurs to the engine.

In accordance with another aspect of the invention, an air intake manifold of an engine is connected to an air cleaner having an inlet port for receiving ambient air and an outlet port for discharging cleaned air. A pipe extends between the outlet port of the air cleaner and the intake manifold. A vacuum switch in the normally open position is connected so that it is responsive to a drop in pressure within the pipe at a predetermined pressure level. Finally, a normally open valve is located within the pipe and operable by a device responding to the vacuum switch, so that the closed valve blocks the pipe to remove the air supply to the engine to shut off the engine.

In accordance with yet another aspect of the present invention, an internal combustion engine having a fuel pump connected to the ignition switch has a normally closed vacuum switch electrically connected in series with the ignition and the fuel pump. The vacuum switch responds to a drop in the pressure level between the air cleaner and the intake manifold by opening the circuit to disconnect the fuel pump from the ignition switch, thereby cutting off the fuel supply to the engine to kill the engine.

DESCRIPTION OF DRAWINGS

For a more complete understanding of the present invention, and for further objects and advantages, reference is now made to the following description taken in conjunction with the accompanying drawings, in which.

DESCRIPTION OF THE PREFERRED EMBODIMENT

Figure 1:
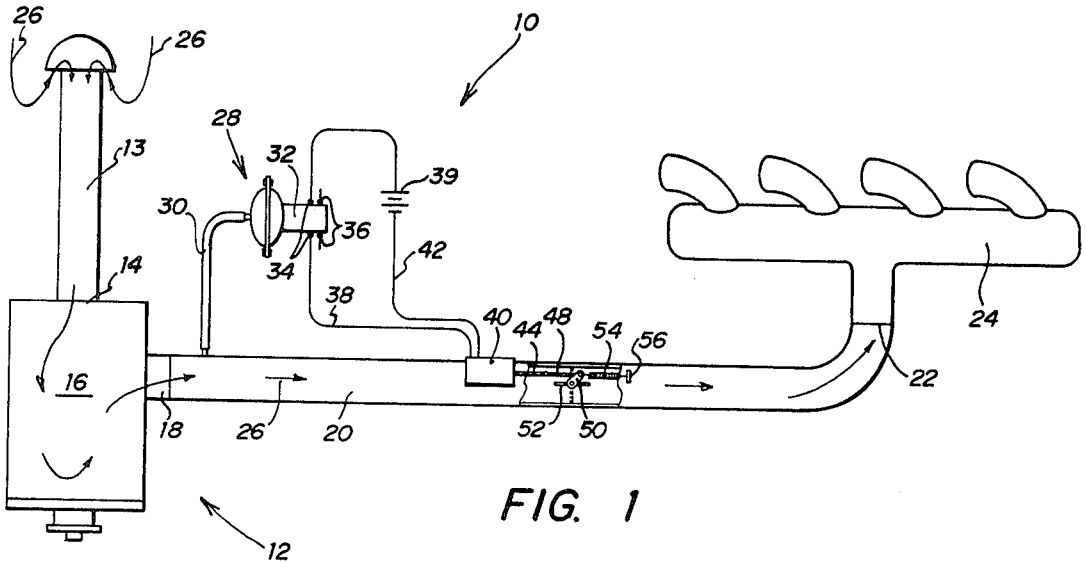
FIG. 1 is a side view partially broken away, of the preferred embodiment of the present invention.

FIG. 1 illustrates the preferred embodiment of the present system, generally referred to by the numeral 10. A conventional heavy duty air cleaning system 12 has a precleaner 13 connected to the inlet port 14 of an air cleaner 16. A discharge port 18 of the air cleaner 16 is connected through a pipe 20 to the inlet port 22 of an engine intake manifold 24. The path of the ambient air through the air cleaning system 12 to the intake manifold 24 is shown by a series of arrows 26.

As is known, the air cleaner 16 has filters (not shown) therein for filtering undesirable foreign particles from the ambient air. When the filters are dirty, they must be replaced to prevent damage to the engine.

The automatic engine shut off system 10 includes a vacuum switch 28 connected to the interior of the pipe 20 by a hose 30. The vacuum switch 28 includes a housing 32 with two pair of terminals 34 and 36. The vacuum switch 28 may be connected in its normally open position through terminals 34 and in its normally closed position through terminals 36. The construction and operation of the vacuum switch 28 is described below in more detail in the description of FIG. 3.

The vacuum switch 28 is shown connected in its normally open position at terminal 34 by a pair of wires 38. One lead of terminal 34 is connected through a wire 38 to one terminal of a battery 39, and the other lead of terminal 34 is connected through a wire 38 to one terminal of a solenoid 40. The other terminal of solenoid 40 is connected through a wire 42 to the other terminal of the battery 39 to complete the circuit.

The solenoid 40 has a rigid arm 44 which is retracted inwardly when the solenoid 40 is operated. The arm 44 is pivotally connected by pin 46 to a rigid member 48 having its other end pivotally connected by a pin 49 to a rigid L-shaped mechanical linkage 50. The linkage 50 extends through the pipe 20 and is connected to a butterfly valve 52. The butterfly valve 52 is illustrated in the normally open position maintained by a biasing spring 54 attached between an anchoring member 56 fixed to the pipe 20 and the L-shaped mechanical linkage 50.

As previously noted, the air cleaning system 12 of heavy construction equipment frequently becomes clogged or obstructed from dirt and other foreign matter present in the air where such equipment is operated. The automatic engine shut off system 10 of the present invention detects an obstruction in the air cleaning system 12 by sensing the resultant pressure drop occurring in pipe 20 through a vacuum switch 28. The vacuum switch 28 is shown connected through terminals 34 so that it is in the normally open position.

The vacuum switch 28 may be preadjusted by well known means to switch states when the internal pressure of pipe 20 drops to a predetermined level. When such a pressure drop in pipe 20 is detected, the vacuum switch 28 closes to energize the solenoid 40 through battery 39. The solenoid 40 operates in the manner described above to rotate the normally open butterfly valve 52 ninety degrees (90°) to a closed position inside pipe 20. When butterfly valve 52 has been rotated 90°, the air supply through pipe 20 is completely cut off from the intake manifold 24. In this manner the automatic engine shut off system cuts off the engine before damage can occur from dirt and other foreign matter being drawn into the engine.

Figure 2:
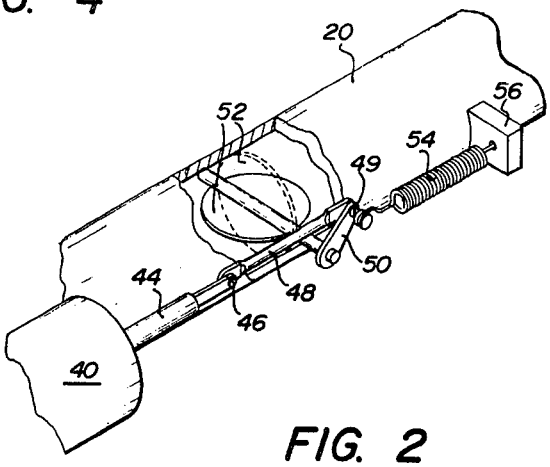
FIG. 2 is a perspective view of the normally open butterfly valve shown in FIG. 1.

FIG. 2 illustrates a perspective view of the butterfly valve 52 in its normally open position within the pipe 20. This view shows in greater detail the operation of solenoid 40 and butterfly valve 52. When the solenoid 40 is energized by closing of the vacuum switch 28 (see FIG. 1) the arm is retracted inwardly thereby pulling the pivotally connected rigid member 48 which causes the L-shaped mechanical linkage 50 to be rotated 90°. This rotation of mechanical linkage 50 also causes the butterfly valve 52, normally held open by biasing spring 54, to be rotated 90° to the closed position. The closed position of butterfly valve 52 completely blocks the flow of all air through the pipe 20.

Figure 3:
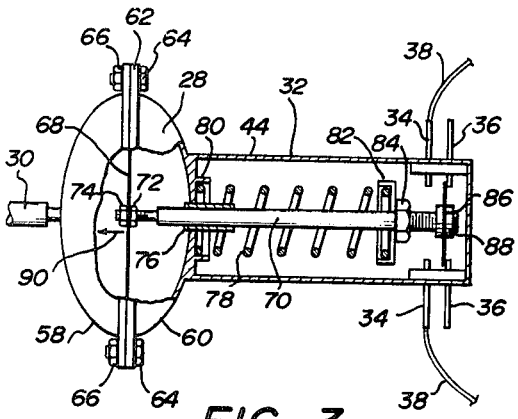
FIG. 3 is a side view, partially broken away, of a vacuum switch used in the present invention.

FIG. 3 illustrates a partially cut away view of a typical vacuum switch 28 for use with the automatic engine cut off system 10 of the preferred embodiment of the invention illustrated in FIG. 1. The vacuum switch 28 includes a pair of hollow hemispheroids 58 and 60 suitably joined at their respective peripheral annular flanges 62 by a plurality of bolts 64 secured by nuts 66. A diaphragm 68 is fixedly held between the hemispheroids 58 and 60 joined at annular flanges 62.

A threaded rod 70 is received within an annular opening 72 of the diaphragm 68 and attached to it by a pair of hexagonal nuts 74 on either side of diaphragm 68. The rod 70 passes through a circular opening 76 in the hemispheroid 60 and is enclosed by the housing 32 attached to the surface of hemispheroid 60. The rod 70 is normally biased by a helical spring 78 compressed between a pair of receiving washers 80 and 82. The washer 82 compresses the spring 78 through adjustment of the nut 84 received on the threaded end of the rod 70. In this manner the tension of the spring 78 may be so adjusted to allow the vacuum switch 28 to operate at a predetermined pressure level within the pipe 20 (see FIG. 1). In addition, the end of rod 70 has a connecting member 86 adjustably held by a pair of nuts 88 with the connecting member 86 in contact with the terminals 36 when the switch 28 is in its normal position.

When the air filters of air cleaning system 12 become clogged, the pressure inside the pipe 20 (see FIG. 1) drops. The hose 30 connects the interior of hemispheroid 58 of vacuum switch 28 to the pipe 20 so that it responds to a pressure drop within the pipe 20. A drop in pressure in the pipe sufficient to overcome the biasing force of the spring 78 causes the diaphragm 68 to be pulled in the direction of arrow 90, thereby further compressing the spring 78 as the movement of the rod 70 in the direction of arrow 90 causes the contact member 86 to engage the terminals 34, closing the circuit between the terminals 34.

Figure 4:
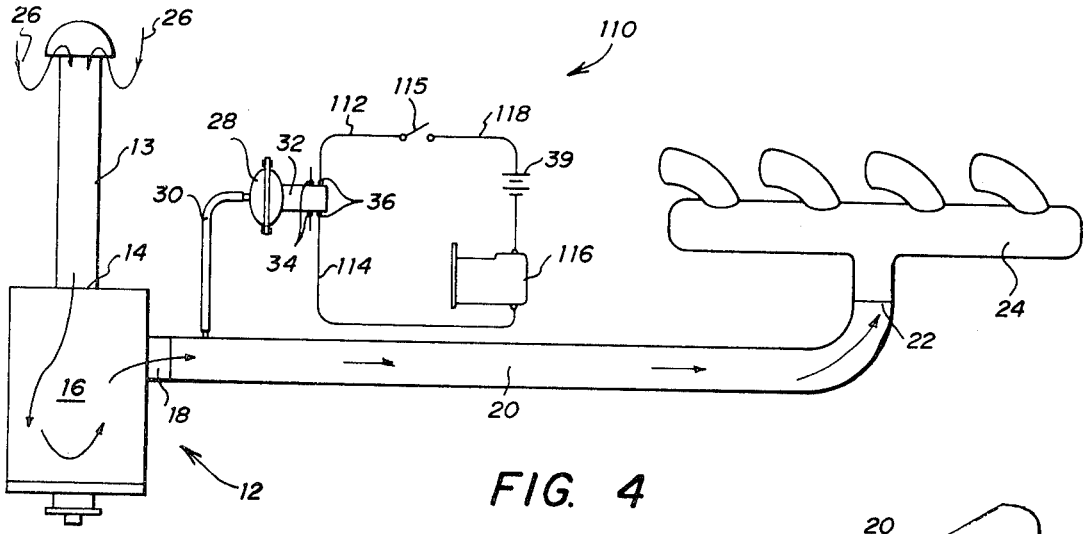
FIG. 4 is a side view of the alternate embodiment of the present invention.

FIG. 4 illustrates an alternate embodiment 110 of an automatic engine shut off system of the present invention. Those elements of FIG. 2 that correspond identically to a member in FIG. 1 are given identical numbers.

In this alternate embodiment 110 of the present invention, the interior pressure of the pipe 20 is connected by a hose 30 to the vacuum switch 28 (shown in greater detail in FIG. 3). But in this embodiment, the vacuum switch 28 is connected in a normally closed position by wires 112 and 114 connected to the terminals 36. The wire 112 connects one terminal of the ignition switch 115 to terminal 36, and the wire 114 connects the other lead of terminal 36 to one terminal of fuel pump 116. A wire 118 connects the other terminal of the ignition switch 15 to the fuel pump 116 to complete the circuit.

In operation of the alternate embodiment 110 of the present invention, the vacuum switch 28 is connected through its terminal 36 to fuel pump 116 and to the ignition switch 115. Thus, when the ignition switch is turned on, the fuel pump 116 operates to supply fuel to the engine. When the vacuum switch 28 senses a drop in pressure in the interior of pipe 20 from an obstructed air filter, the vacuum switch 28 opens in the manner described above to open the circuit at terminals 36. This change in state in vacuum switch 28 cuts off all fuel to the engine, thereby killing the engine automatically before any damage is done to the engine.

Although a preferred embodiment and an alternate embodiment of the present invention have been illustrated in the accompanying drawings and described in the foregoing detailed description, it will be understood that the invention is not limited to the embodiments as disclosed, they are capable of numerous rearrangements, modifications, and substitution of parts and elements without departing from the spirit of the invention.

What is claimed is:

1. An automatic engine shut off system for an internal combustion engine having an air cleaning system connected by a pipe to the intake manifold of the engine comprising:

means for sensing a pressure decrease to a predetermined level in the air cleaning connection pipe resulting from an obstruction of the air cleaning system, means responsive to said sensing means for automatically shutting off the engine before damage occurs to the engine due to the obstruction of the air cleaning system, and said sensing means including a normally closed vacuum switch responsive to the pressure level within the air cleaning connection pipe, whereby said vacuum switch opens in response to a decrease in the pressure level to a predetermined level.

2. The automatic engine shut off system of claim 1 wherein said vacuum switch is connected between the engine ignition switch and the fuel pump and is operable to open the circuit between said ignition switch and said pump, thereby cutting off the fuel supply to the engine to shut off the engine when the pressure within the air cleaning connection pipe drops to a predetermined level from an obstruction in the air cleaning system.

3. In an internal combustion engine having an ignition switch connected to a fuel pump, an automatic shut off system for connection between the engine air cleaner and intake manifold comprising:

a normaly closed vacuum switch electrically connected in series with the ignition switch and the fuel pump, said vacuum switch responsive to a drop in the pressure level between the air cleaner and the intake manifold to be switched to an open position to disconnect the fuel pump from the ignition switch, thereby cutting off the fuel supply to the engine to shut off the engine.

4. The automatic engine shut off system of claim 3 and further comprising a hose having one end attached to said vacuum switch and the other end attached to a pipe extending between the air cleaner and the intake manifold of the engine.

5. The automatic engine shut off system of claim 3 and further comprising one terminal of said normally closed vacuum switch electrically connected to a terminal of the ignition switch and another terminal of said vacuum switch connected to a terminal of the fuel pump, whereby the opening of said vacuum switch electrically disconnects the fuel pump from the ignition switch when the engine is running.

* * * * *